US005950337A

United States Patent [19]

Lehrman

[11] Patent Number: 5,950,337

[45] Date of Patent: Sep. 14, 1999

[54] HANGING ATTACHMENT FOR HANGING AN IRONING BOARD ASSEMBLY FROM AN UPPER EDGE OF A DOOR

[76] Inventor: David Lehrman, 207 Barclay Cir., Cheltenham, Pa. 19102

[21] Appl. No.: 09/004,152

[22] Filed: Jan. 7, 1998

[51] Int. Cl.[6] ..... D06F 81/06; A47B 96/06

[52] U.S. Cl. ..... 38/103; 38/141; 248/215; 248/305

[58] Field of Search ..... 38/103, 137, DIG. 1, 38/DIG. 2, DIG. 3; 248/304, 305, 215, 339; 108/42, 47, 48

[56] References Cited

U.S. PATENT DOCUMENTS

| | | | |
|---|---|---|---|
| 373,472 | 11/1887 | Moser . | |
| 1,661,837 | 3/1928 | Little . | |
| 2,286,539 | 6/1942 | Hagerstrom . | |
| 2,500,471 | 3/1950 | Schmiedt . | |
| 2,633,998 | 4/1953 | Derman . | |
| 2,743,023 | 4/1956 | Larson . | |
| 2,842,822 | 7/1958 | Bennett . | |
| 2,925,916 | 2/1960 | Pollock . | |
| 2,959,297 | 11/1960 | Larson . | |
| 3,536,287 | 10/1970 | Kramer . | |
| 3,782,559 | 1/1974 | Wright . | |
| 4,429,848 | 2/1984 | Gunsolus | 248/305 X |
| 4,657,249 | 4/1987 | Offutt . | |
| 4,662,629 | 5/1987 | Plovie . | |
| 4,862,611 | 9/1989 | Wright . | |
| 4,899,667 | 2/1990 | Miller et al. . | |
| 4,944,434 | 7/1990 | Hamilton . | |
| 4,949,924 | 8/1990 | Carmody . | |
| 5,014,948 | 5/1991 | Asaro et al. | 248/215 |
| 5,413,297 | 5/1995 | Adams | 248/215 |
| 5,472,164 | 12/1995 | Contee, Jr. . | |
| 5,553,823 | 9/1996 | Protz, Jr. . | |
| 5,810,304 | 9/1998 | Lehrman | 248/215 |

FOREIGN PATENT DOCUMENTS

| | | |
|---|---|---|
| 515889 | 4/1921 | France . |
| 821642 | 12/1937 | France . |
| 293132 | 7/1928 | United Kingdom . |

OTHER PUBLICATIONS

Photocopy of brochure "Ironees® Over–The–Door Ironing Table Holder", 1 page identified as PR3451, The Ironees Company.

*Primary Examiner*—Ismael Izaguirre

*Attorney, Agent, or Firm*—Panitch Schwarze Jacobs & Nadel, P.C.

[57] ABSTRACT

A hanging attachment for hanging an ironing board assembly from an upper edge of a door, the ironing board assembly includes an ironing table and a pair of collapsible legs, where each leg has a foot section for resting on a floor when the ironing board assembly is in a raised state. The ironing table extends generally longitudinally, and the foot section of each leg extends generally transversely with respect to the ironing table. The hanging attachment comprises a first hanger for being transversely arranged on the foot section of one of the legs. The hanger has an attaching portion securely attaching the hanger to the foot section, and a hooking portion secured to the attaching portion. The hooking portion is for being hooked over the upper edge of the door.

20 Claims, 2 Drawing Sheets

HANGING ATTACHMENT FOR HANGING AN IRONING BOARD ASSEMBLY FROM AN UPPER EDGE OF A DOOR

CROSS-REFERENCE TO RELATED APPLICATIONS

Not applicable.

FIELD OF THE INVENTION

The present invention relates to a hanging attachment for hanging an apparatus during storage thereof. More particularly, the present invention relates to such a hanging attachment for hanging an ironing board assembly from an upper edge of a door or the like.

BACKGROUND OF THE INVENTION

As is known, a typical ironing board assembly is foldable or otherwise collapsible. Accordingly, after use thereof, the assembly may be folded or collapsed and then stored in an inconspicuous or out-of-the-way area such as in a closet, behind a door, etc. During storage, the assembly is commonly stood up in a near-vertical position and leaned against a vertical surface.

However, such a stood-up ironing board assembly consumes valuable floor space and is prone to being knocked over or otherwise toppled. In particular, a playing child, a roving pet, or the like may unintentionally or intentionally apply a sufficient horizontal force to topple the assembly, and as should be evident, the toppling assembly may significantly injure the aforementioned child, pet, and/or other adjacent objects should the toppling assembly come in contact therewith. Moreover, it is likely during the aforementioned toppling event that the legs of the assembly will extend, thereby causing additional damage and/or injury during such toppling.

Accordingly, a need exists for a device that will allow an ironing board assembly to be safely stored out of the way such that valuable floor space is not occupied, and such that accidental toppling of the stored assembly is prevented or at least minimized.

BRIEF SUMMARY OF THE INVENTION

The aforementioned need is satisfied by a hanging attachment for hanging an ironing board assembly from an upper edge of a door. The ironing board assembly has an ironing table and a pair of collapsible legs, where each leg has a foot section for resting on a floor when the ironing board assembly is in a raised state. The ironing table extends generally longitudinally, and the foot section of each leg extends generally transversely with respect to the ironing table.

The hanging attachment comprises a first hanger arranged on the foot section of one of the legs. The hanger has an attaching portion securely attaching the hanger to the foot section, and a hooking portion secured to the attaching portion. The hooking portion is for being hooked over the upper edge of the door.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
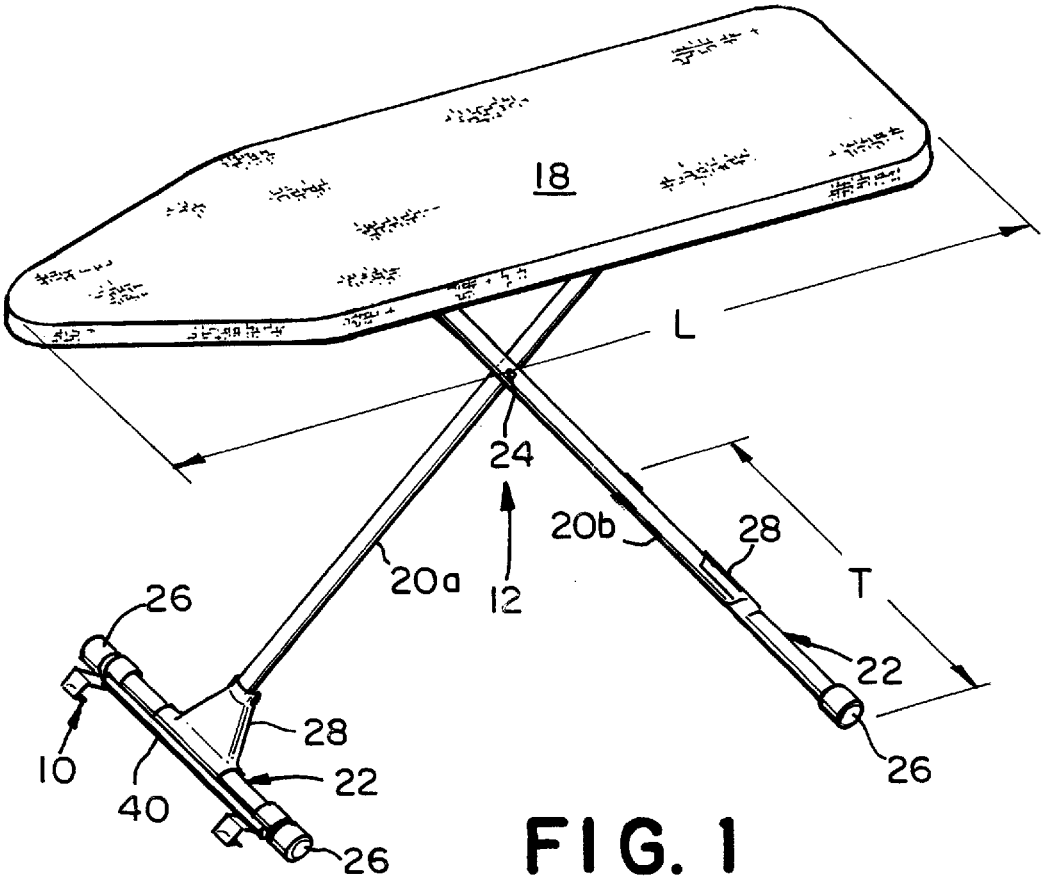
FIG. 1 is a perspective view of an ironing board assembly with the hanging attachment of the present invention, and shows the ironing board assembly in a raised state.

Certain terminology may be used in the following description for convenience only and is not limiting. "Left", "right", "upper", and "lower" designate directions in the drawings to which a reference is made. The words "inwardly" and "outwardly" are further directions toward and away from, respectively, the geometric center of a referenced object. The terminology includes the words above specifically mentioned, derivatives thereof, and words of similar import.

Figure 2A:
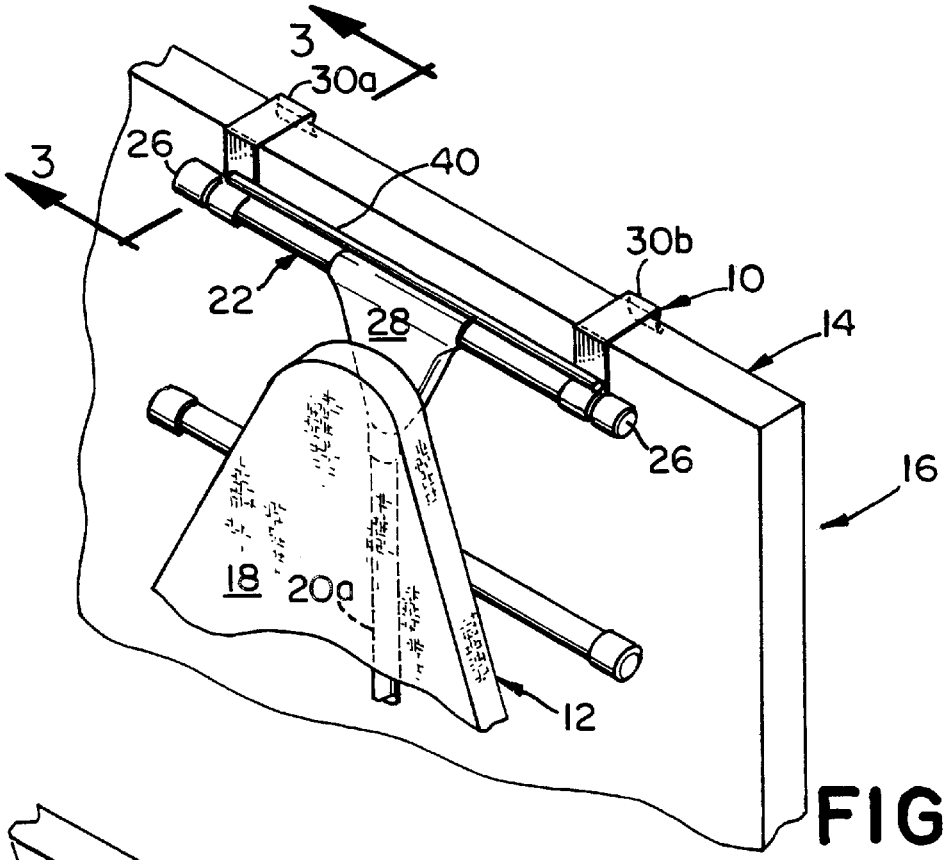
FIG. 2A is a cut-away perspective view of a portion of the ironing board assembly and of the hanging attachment of FIG. 1, and shows the ironing board assembly in a collapsed state, with the hanging attachment hanging the collapsed ironing board assembly from the upper edge of a door.

Referring to the drawings in detail, wherein like numerals are used to indicate like elements throughout, there is shown in FIG. 1 a hanging attachment 10 for hanging an ironing board assembly 12 from an upper edge 14 of a door 16 (as seen in FIG. 2A) in accordance with a preferred embodiment of the present invention. As seen in FIG. 1, the ironing board assembly has an ironing table or surface 18 and a pair of collapsible legs 20*a*, 20*b*, where each leg 20*a*, 20*b* has a foot section 22 for resting on a floor when the ironing board assembly 12 is in a raised state (as seen in FIG. 1). As shown, the hanging attachment 10 is attached to one of the legs 20*a*, 20*b*.

As shown, the ironing table 18 of the ironing board assembly 12 typically has a shape typical of many ironing tables. Specifically, the ironing table 18 extends generally longitudinally, as shown by the line L in FIG. 1, and has a generally squared longitudinal end and an opposing, generally tapering longitudinal end. Of course, one skilled in the art will recognize that the particular details of the shape of the generally longitudinal ironing table 18 can vary while still being within the spirit and scope of the present invention. As also seen in FIG. 1, the foot section 22 of each leg 20*a*, 20*b* typically extends generally transversely with respect to the ironing table 18, as shown by the line T in FIG. 1.

Typically, the legs 20*a*, 20*b* of the ironing board assembly 12 pivot with respect to each other at a pivot 24. Also typically, one of the legs 20*a*, 20*b* is pivotally attached to the ironing table 18 at a fixed location (not shown), and the other of the legs 20*a*, 20*b* is pivotally, slidably attached to the ironing table 18 (also not shown). A releasable locking mechanism (also not shown) is provided on the ironing table 18 to lock the slidably attached one of the legs 20*a*, 20*b* in a raised position, and to allow such slidably attached one of the legs 20*a*, 20*b* to slide toward a collapsed position when released, thereby allowing the legs 20*a*, 20*b* to move between raised and collapsed positions and likewise allowing the ironing board assembly to be moved between raised and collapsed states, as should be understood by one skilled in the art.

Of course, one skilled in the art will recognize that many different types of raising/collapsing arrangements may be employed in connection with the ironing board assemblies 12 without departing from the spirit and scope of the present invention. As an example, and as is known, rather than using a releasable locking mechanism and a slidably attached leg, a clamping or clipping mechanism may be employed on the ironing table 18 to securely releasably receive an upper portion of the leg.

Figure 3:
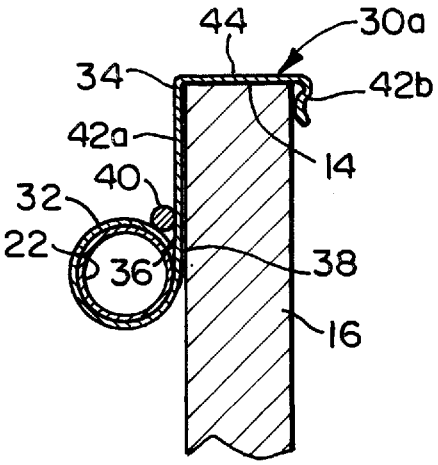
FIG. 3 is a cross-sectional view taken along line 3—3 in FIG. 2A.

As seen in FIGS. 1 and 2A and 3, in the preferred embodiment of the present invention, the foot section 22 is a generally tubular material extending transversely with respect to the ironing table 18 (along the line T in FIG. 1), and includes end caps 26. As should be understood, the end caps 26 allow the ironing board assembly 12 to rest on a floor without marring or otherwise damaging such floor. Typically, both the legs 20*a*, 20*b* and the foot sections 22 are constructed from tubular steel, and the end caps 26 are a plastic or rubber material or the like. However, one skilled in the art will recognize that other appropriate materials may be employed without departing from the spirit and scope of the present invention.

Moreover, although it is preferable that the legs 20*a*, 20*b*, and the foot sections 22 are tubular in cross-section, one skilled in the art will also recognize that other cross-sectional configurations may be employed without departing from the spirit and scope of the present invention. For example, such elements may have a square or rectangular configuration in cross-section.

As seen in FIGS. 1 and 2A, in the preferred embodiment of the present invention, the ironing board assembly 12 may also have a support bracket 28 arranged at the juncture of each leg 20*a*, 20*b* and its respective foot section 22. As should be understood, the support bracket 28 securely fixes the foot section 22 to the respective leg 20*a*, 20*b*, provides structural support, and otherwise maintains the foot section 22 in the transverse orientation (as represented by the line T in FIG. 1). However, one skilled in the art will recognize that many different types of support brackets 28 and the like may be employed in the present invention to perform such functions without departing from the spirit and scope of the present invention.

Referring now to FIGS. 2A and 3, it is seen that when the ironing board assembly 12 is in the collapsed state, the hanging attachment 10 may be adjusted on the ironing board assembly 12 and hung over the upper edge 14 of the door 16 to securely support the ironing board assembly 12 out of the way on the door 16. Preferably, and as seen, the hanging attachment 10 comprises first and second hangers 30*a*, 30*b* that are transversely arranged on the foot section 22 of the leg 20*a* (i.e., along the line T of FIG. 1) and spaced a distance apart and on either side of the center of balance of the ironing board assembly 12. Importantly, it should be appreciated by one skilled in the art that the hanging attachment may alternatively comprise a single hanger 30 (not shown). In such a case, the hanger should be positioned essentially on the center of balance of the ironing board assembly 12. Preferably, the hanging attachment 10 is rotatable about the foot section 22 such that when the ironing board assembly 12 is removed from the door 16 and is moved into a raised state, the hanging attachment 10 may be rotated on the foot section 22 out of the way (as best seen in FIG. 1) such that the end caps 26 of the foot section 22 rest on the floor without hindrance from the hanging attachment 10.

Referring to FIG. 3 now, each hanger 30*a*, 30*b* has an attaching portion 32 securely attaching such hanger 30*a*, 30*b* to the foot section 22, and a hooking portion 34 secured to the attaching portion 32, where the hooking portion 34 is for being hooked over the upper edge 14 of the door 16. Preferably, each hanger 30*a*, 30*b* comprises a substantially unitary body and more preferably, the unitary body is sheet metal. Of course, one skilled in the art will recognize that other appropriate materials, such as a polymeric material, may be employed to form each hanger 30*a*, 30*b* without departing from the spirit and scope of the present invention, so long as the chosen material possesses the requisite strength to support the hanging board assembly 12 without deformation or breakdown.

Preferably, the attaching portion 32 is one end of the unitary body and is bent or otherwise formed during construction to substantially form an open enclosure. That is to say, the attaching portion 32 is preferably substantially an open enclosure that when mounted to the foot section 22, substantially completely surrounds a portion of the foot section 22 while the foot section 22 extends therethrough.

As seen in FIG. 3, the open enclosure is preferably formed or constructed by bending back an edge 36 of the one end of the unitary body that is the hanger 30*a*, and positioning the bent-back edge 36 adjacent the mid-portion 38 of the unitary body. Accordingly, the open enclosure which is the attaching portion 32 is a substantially open-ended cylindrical body. Of course, one skilled in the art will recognize that other types of open enclosures and other methods of forming the open enclosure which is the attaching portion 32 may be employed without departing from the spirit and scope of the present invention. As but one example, the open enclosure may be polygonal, and may be molded in its finished form. Moreover, one skilled in the art will recognize that the use of the term 'bent' and variations thereof herein shall include formation by bending, molding, and the like, as well as all other methods of formation wherein the result is a bent shape or appearance.

Preferably, the open enclosure which is the attaching portion 32 has a generally transversely extending axis (extending along the line T in FIG. 1) such that the portion of the generally transversely extending foot section 22 of the leg 20*a* is accommodated therein. While it is preferred that the attaching portion 32 be in the form of an open enclosure, it is understood by those of ordinary skill in the art that each hanger 30*a*, 30*b* could be secured to the foot section 22 in other manners (not shown). For instance, a circumferential slot could be formed on the foot section 22 and the attaching portion could be T-shaped (not shown) with the horizontal portion of the T being transversely disposed within the foot section and the vertical portion of the T extending through the slot, all without departing from the spirit and scope of the invention.

Preferably, and as seen in FIGS. 1, 2A and 3, the hanging attachment 10 also includes a transversely oriented connector 40 connecting the first and second hangers 30*a*, 30*b* and defining a predetermined spacing between such first and second hangers 30*a*, 30*b*. Preferably, the predetermined spacing defined by the connector 40 is such that the hangers 30*a*, 30*b* are relatively far apart. Accordingly, and as one skilled in the art will recognize, the ironing board assembly 12 may be hung by the hanging attachment 10 in a more structurally and mechanically sound manner.

Preferably, the connector 40 comprises a substantially straight metal rod that is securely attached to each of the first and second hangers 30*a*, 30*b*, by welding or the like. However, one skilled in the art will recognize that other shapes and other types of connectors and connector materials may be employed, and that other appropriate means for securely attaching the connector 40 to the hangers 30*a*, 30*b*, may be employed, all without departing from the spirit and scope of the present invention. For example, if the hangers 30*a*, 30*b* are both a plastic material, then the connector 40 may also be a plastic material, and may be fused or sonicly welded to the hangers 30*a*, 30*b*.

Preferably, and as best seen in FIG. 3, the connector 40 is attached to each hanger 30*a*, 30*b* such that the connector 40 joins the edge 36 of each hanger to the respective mid-portion 38. Accordingly, the connector 40 completes each open enclosure such that each attaching portion 32 does not become undone over time under the weight of the ironing board assembly 12.

Preferably, the hooking portion 34 secured to the attaching portion 32 is the other end of the unitary body opposite the attaching portion 32, and is bent to form opposing side sections 42*a*, 42*b* and an interconnecting section 44 interconnecting the side sections 42*a*, 42*b*. Accordingly, when the hanging attachment 10 is positioned over the upper edge 14 of the door 16, the opposing side sections 42*a*, 42*b* are adjacent opposite sides of the door 16 and the interconnecting section 44 is adjacent the upper edge 14 of the door 16, as is seen in FIG. 3. As seen, the side section 42*b* on the side of the door 16 opposite from the attaching portion 32 preferably has an S-curved shape in cross-section. Accordingly, the side section 42*b* may be able to 'give' somewhat to accommodate a wider door 16, and the likelihood that the edge of the side section 42*b* will mar the door during hanging of the ironing board assembly 12 is minimized.

In an alternate embodiment of the present invention, the hooking portion 34 may simply comprise an aperture (not shown) defined on or above the attaching portion 32. As may be appreciated, the aperture may be sized to receive a nail, screw or other projection securely fixed to the side of the door 16. Accordingly, the hanging attachment 10 and therefore the ironing board assembly 12 would be hung from the door 16 by way of the projection and the aperture.

Preferably, each hanger 30*a*, 30*b* is formed from a length of material and is appropriately bent or otherwise formed to construct the attaching portion 32 and hooking portion 34. If, as is preferable, each hanger 30*a*, 30*b* is constructed from sheet metal, it is preferable that the material be approximately one-half to one inch wide and six to twelve inches long, and that the material have a thickness no greater than about one-sixteenth to one-eighth inch. Importantly, the thickness must be small enough so that hooking portion 34 does not obstruct closure of the door 16, and so that the end caps 26 of the foot section 22 rest on the floor without hindrance from the attaching portion 32. Preferably, each hanger 30*a*, 30*b* is constructed from sheet metal by appropriately bending by appropriate machinery and/or tools to form the attaching portion 32 and hooking portion 34.

Preferably, the diameter of the open cylinder which is the attaching portion 32 is slightly larger than the diameter or largest cross-sectional dimension of the tubular steel of the foot section 22 that is to extend therethrough. Typically, such foot section 22 has a one or one and one-eighth inch diameter, but may of course be larger or smaller. Preferably, the length of the interconnecting section 44 of the hooking portion 34 (i.e., from one side sections 42*a* to the other 42*b*) is slightly larger than the thickness of a typical door 16. Although such a door 16 typically has a thickness of about one and three-eighths inches, such thickness may of course also be larger or smaller.

Preferably, the hanging attachment 10 is constructed apart from the ironing board assembly 12, and therefore must be mounted to the foot section 22 of the leg 20*a*. Preferably, such mounting takes place by removing both end caps 26 (if they are already installed), slipping one end of the foot section 22 through a respective one of the hangers 30*a*, 30*b*, moving the hanging attachment 10 toward the other end of the foot section 22, slipping the other end of the foot section 22 through the other respective one of the hangers 30*a*, 30*b*, and moving the hanging attachment 10 back toward the one end of the foot section 22 to center the hanging attachment 10 on the foot section 22, and then replacing (or installing) the end caps 26 on the foot section 22 to secure the hanging attachment 10 on the foot section 22. Preferably, either the connector 40 can provide enough "give" or the radius of the open enclosure which is the attaching portion 32 is wide enough to provide enough "play" such that the hanging attachment may relatively easily be movable toward the open end of the foot section 22 despite the protruding unattached one of the hangers 30*a*, 30*b*.

Of course, in performing the aforementioned procedure, care must be taken to mount the hanging attachment 10 with the hooking portions 34 of the hangers 30*a*, 30*b* facing in the proper direction. Preferably, the end caps 26 have a large-enough radial thickness and the attaching portion has a small-enough radius such that each attaching portion 32 cannot slip over its respective end cap 26 and the hanging attachment 10 cannot likewise slip off the foot section 22.

Figure 2B:
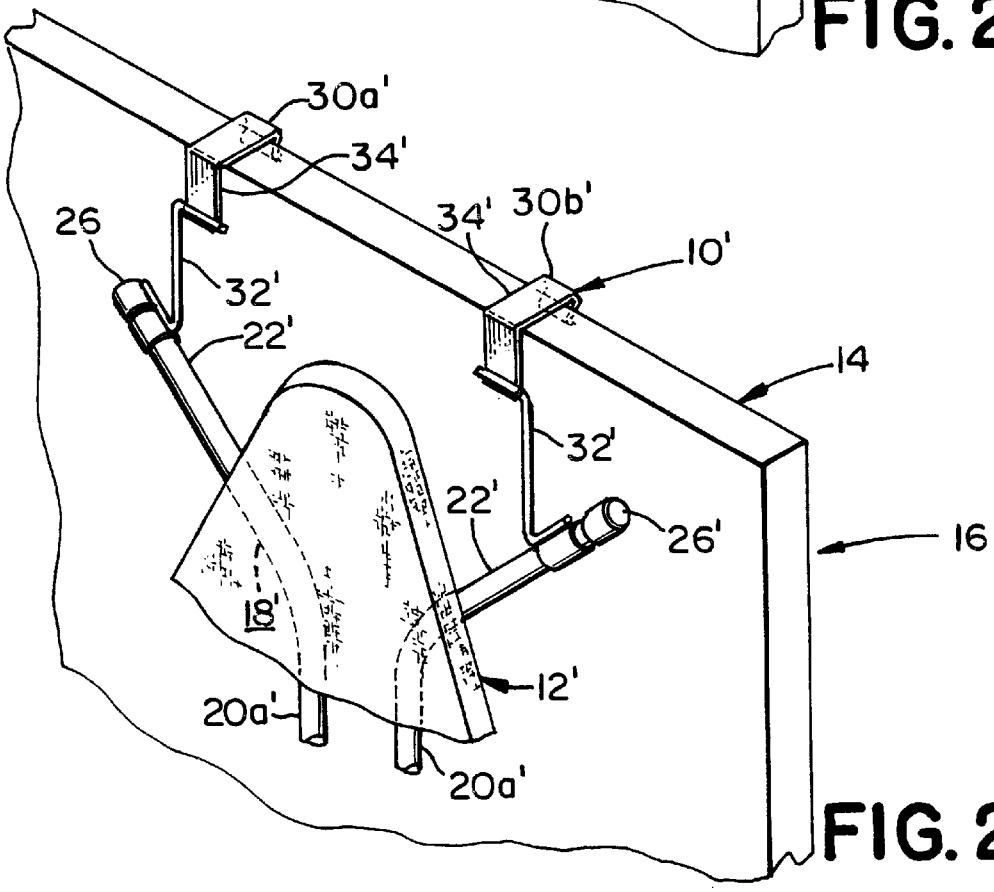
FIG. 2B is a cut-away perspective view similar to that shown in FIG. 2A, and shows an alternate embodiment of the ironing board assembly and hanging attachment.

The ironing board assembly 12 shown in FIGS. 1 and 2A has legs 20*a*, 20*b* that are single tubes and foot sections 22 that are generally perpendicular to their respective legs 20*a*, 20*b*. However, and referring now to FIG. 2B, it is to be appreciated that some ironing board assemblies 12' have legs 20*a*', 20*b*' (20*b*' not shown), where each leg 20*a*', 20*b*' comprises a pair of leg tubes or the like extending in parallel, and where each foot section 22' comprises an angled ped extending off from each of the parallel leg tubes. In such a case, and in an alternate embodiment of the present invention, a pair of hangers 30*a*', 30*b*', as shown in FIG. 2B may be employed to hang the ironing board assembly 12' from the upper edge 14 of the door 16.

As seen, the hooking portion 34' of each hanger 30*a*', 30*b*' is substantially similar if not identical to the hooking portion 34 of the hangers 30*a*, 30*b*. However, the attaching portion 32' is different, owing to the fact that each ped extends generally at an angle.

For example, and as seen, to accommodate the angled ped, the attaching portion 32' may include an open enclosure for having a portion of a respective ped extending therethrough in a generally angled direction, and an angled rod or the like attaching the open enclosure to the hanging portion 34'. Of course, one skilled in the art will appreciate that many particular types of constructions may be employed for the hangers 30*a*', 30*b*', all without departing from the spirit and scope of the present invention.

For example, each hanger 30*a*', 30*b*' may alternately be formed from a unitary body such as a length of steel, as with each hanger 30*a*, 30*b*. However, the more complex geometry presented by the ironing board assembly 12' requires that the length of steel be bent into a more complex shape than that shown for the hangers 30*a*, 30*b*, at least with regard to the attaching portion 32'. One skilled in the art will appreciate that the hanging attachment 10' preferably does not include any connector connecting the hangers 30*a*', 30*b*', such as the connector 40, especially inasmuch as such a connector would interfere with the rotation of the hanging attachment 10' on the angled peds of the foot section 22'. In particular, such a connector would not allow the hanging attachment 10' to rotate out of the way when the ironing board assembly 10' is in a raised position such that the end caps 26 on the angled peds of the foot section 22' could rest on the floor without hindrance from the hanging attachment 10'. Moreover, while the attaching portion 32' is preferably in the form of an open enclosure, it is understood by those of ordinary skill in the art from this disclosure that the attaching portion 32' could be generally C-shaped in cross section (not shown) and be snap fit over the ped of each foot section 22'.

It will be appreciated by those skilled in the art that changes could be made to the embodiments described above without departing from the broad inventive concepts thereof. It is to be understood, therefore, that this invention is not limited to the particular embodiments disclosed, but it is intended to cover modifications within the spirit and scope of the present invention as defined by the appended claims.

I claim:

1. A hanging attachment for hanging an ironing board assembly from an upper edge of a door, the ironing board assembly including an ironing table and a pair of collapsible legs, each leg having a foot section for resting on a floor when the ironing board assembly is in a raised state, the ironing table extending generally longitudinally, the foot section of each leg extending generally transversely with respect to the ironing table, the hanging attachment comprising:

a first hanger for being arranged on the foot section of one of the legs, the first hanger having an attaching portion for securely attaching the hanger to the foot section and a hooking portion secured to the attaching portion, the hooking portion for being hooked over the upper edge of the door.

2. The hanging attachment of claim 1 further comprising a second hanger for being arranged on the foot section of the one of the legs, the second hanger having an attaching portion for securely attaching the second hanger to the foot section and a hooking portion secured to the attaching portion thereof, the hooking section of the second hanger for being hooked over the upper edge of the door, the first and second hangers for being transversely arranged on the foot section.

3. The hanging attachment of claim 2 further comprising a transversely oriented connector connecting the first and second hangers and defining a predetermined spacing between the first and second hangers.

4. The hanging attachment of claim 2 wherein each hanger comprises a substantially unitary body.

5. The hanging attachment of claim 4 wherein the unitary body is sheet metal.

6. The hanging attachment of claim 4 wherein the attaching portion is one end of the unitary body and is bent to substantially form an open enclosure, the open enclosure for having a portion of the foot section of the leg of the ironing board assembly extending therethrough.

7. The hanging attachment of claim 6 wherein the open enclosure is formed by bending back an edge of the one end of the unitary body and positioning the bent-back edge adjacent a mid-portion of the unitary body, the hanging attachment further comprising a transversely oriented connector connecting the first and second hangers and defining a predetermined spacing between the first and second hangers, the connector being attached to each hanger to join the edge of each hanger to the respective mid-portion.

8. The hanging attachment of claim 6 wherein the open enclosure has a generally transversely extending axis for having a portion of the foot section of the leg of the ironing board assembly extending therethrough in a generally transverse direction.

9. The hanging attachment of claim 6 wherein the open enclosure is substantially an open cylinder.

10. The hanging attachment of claim 4 wherein the hooking portion is one end of the unitary body and is bent to form opposing side sections and an interconnecting section interconnecting the side sections, the opposing side sections for being adjacent opposite sides of the door and the interconnecting section for being adjacent the upper edge of the door.

11. An ironing board assembly comprising an ironing table and a pair of collapsible legs, each leg having a foot section for resting on a floor when the ironing board assembly is in a raised state, the ironing table extending generally longitudinally, the foot section of each leg extending generally transversely with respect to the ironing table, the ironing board assembly further comprising a hanging attachment for hanging the ironing board assembly from an upper edge of a door, the hanging attachment having:

a first hanger arranged on the foot section of one of the legs, the first hanger having an attaching portion securely attaching the hanger to the foot section and a hooking portion secured to the attaching portion, the hooking portion for being hooked over the upper edge of the door.

12. The ironing board assembly of claim 11 further comprising a second hanger arranged on the foot section of the one of the legs, the second hanger having an attaching portion securely attaching the second hanger to the foot section and a hooking portion secured to the attaching portion thereof, the hooking section of the second hanger for being hooked over the upper edge of the door, the first and second hangers being transversely arranged on the foot section.

13. The ironing board assembly of claim 12 further comprising a transversely oriented connector connecting the first and second hangers and defining a predetermined spacing between the first and second hangers.

14. The ironing board assembly of claim 12 wherein each hanger comprises a substantially unitary body.

15. The ironing board assembly of claim 14 wherein the unitary body is sheet metal.

16. The ironing board assembly of claim 14 wherein the attaching portion is one end of the unitary body and is bent to substantially form an open enclosure, the open enclosure for having a portion of the foot section of the leg of the ironing board assembly extending therethrough.

17. The ironing board assembly of claim 16 wherein the open enclosure is formed by bending back an edge of the one end of the unitary body and positioning the bent-back edge adjacent a mid-portion of the unitary body, the ironing board assembly further comprising a transversely oriented connector connecting the first and second hangers and defining a predetermined spacing between the first and second hangers, the connector being attached to each hanger to join the edge of each hanger to the respective mid-portion.

18. The ironing board assembly of claim 16 wherein the open enclosure has a generally transversely extending axis for having a portion of the foot section of the leg of the ironing board assembly extending therethrough in a generally transverse direction.

19. The ironing board assembly of claim 16 wherein the open enclosure is substantially an open cylinder.

20. The ironing board assembly of claim 14 wherein the hooking portion is one end of the unitary body and is bent to form opposing side sections and an interconnecting section interconnecting the side sections, the opposing side sections for being adjacent opposite sides of the door and the interconnecting section for being adjacent the upper edge of the door.

* * * * *